United States Patent [19]

Schultz

[11] 4,184,628

[45] Jan. 22, 1980

[54] MAILING ASSEMBLY

[76] Inventor: Frank L. Schultz, P.O. Box 517, Alamo, Tex. 78516

[21] Appl. No.: 860,075

[22] Filed: Dec. 13, 1977

Related U.S. Application Data

[63] Continuation-in-part of Ser. No. 659,034, Feb. 18, 1976, abandoned.

[51] Int. Cl.[2] ..... B65D 27/00

[52] U.S. Cl. ..... 229/68 R; 24/17 B; 206/215; 206/451

[58] Field of Search ..... 206/214, 215, 232, 425, 206/451; 229/92.8, 92, 68 R, 77, 79; 24/17 A, 17 B, 17 AP

[56] References Cited

U.S. PATENT DOCUMENTS

| | | | |
|---|---|---|---|
| 416,472 | 12/1889 | Loughery | 24/17 A |
| 480,582 | 8/1892 | Hardy | 229/92 |
| 510,621 | 12/1893 | Van Derveer | 24/17 A |
| 584,290 | 6/1897 | Musson | 229/79 |
| 764,653 | 7/1904 | Witte | 229/79 |
| 978,591 | 12/1910 | Jayne | 24/17 A |
| 1,633,369 | 6/1927 | Hollar, Jr. | 229/79 |
| 1,719,617 | 7/1929 | Novick | 24/17 A |
| 1,793,328 | 2/1931 | La Bombard et al. | 24/17 A |

*Primary Examiner*—Stephen P. Garbe
*Attorney, Agent, or Firm*—Glenn E. Wise

[57] ABSTRACT

Two or more initially independent mailable items, each containing or carrying separate and usually different communications are banded, or otherwise held together, for mailing as a single mailing piece. One of the independent mailable items may carry postage in stamp or in printed postage indicia form as well as address information on one of its exposed faces. Alternatively such postage and address information may be carried by a band, or other means, utilized for holding the otherwise independent items together. The assembly is intended primarily but not exclusively, for use in mailing third class mailing material and allows plural, independent communications items to be mailed, under existing United States government postal rate schedules, at less total cost than if each independent communications item were to be mailed separately.

12 Claims, 18 Drawing Figures

Fig. 1
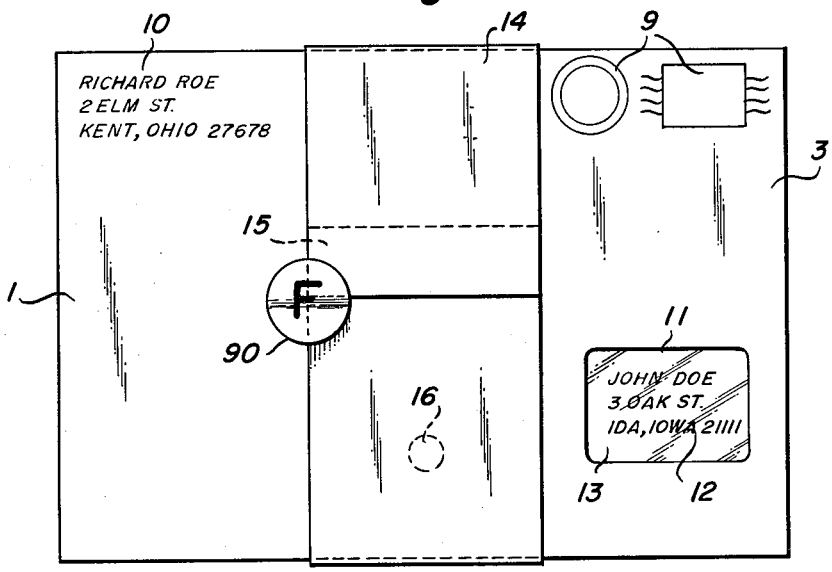
Fig. 2
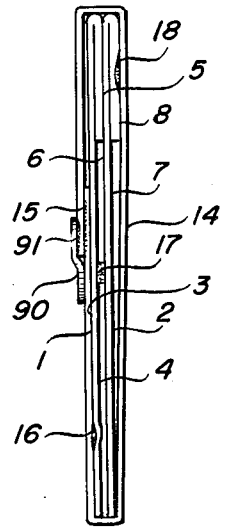
Fig. 3
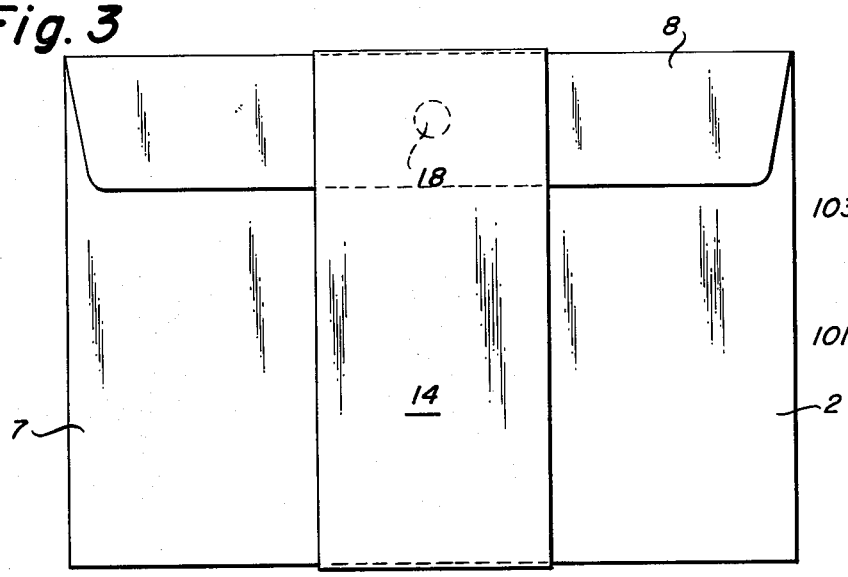
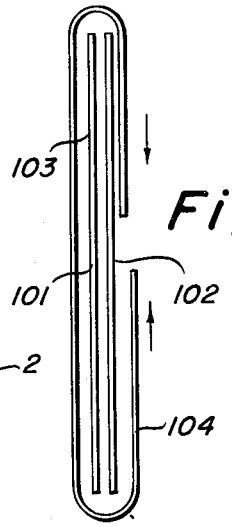
Fig. 12
Fig. 4
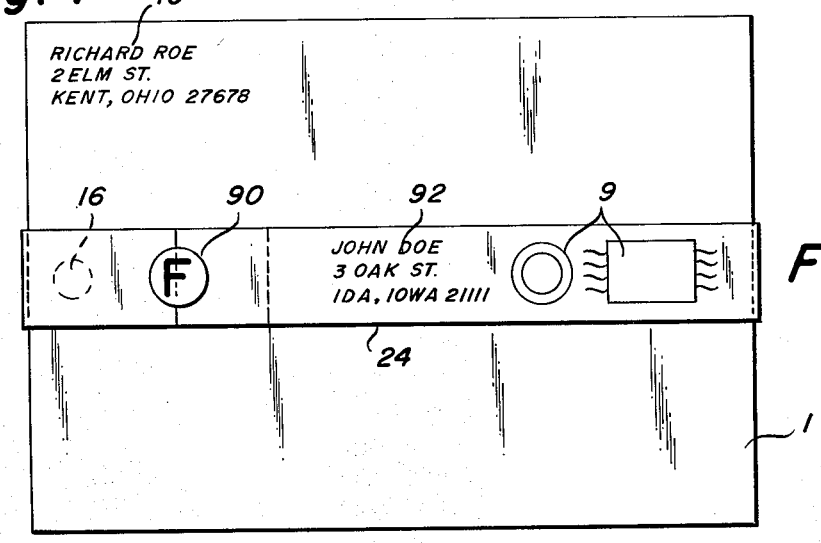
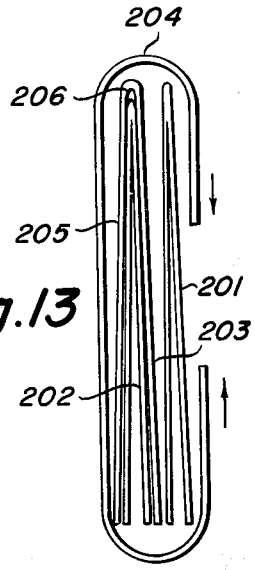
Fig. 13

Fig. 14
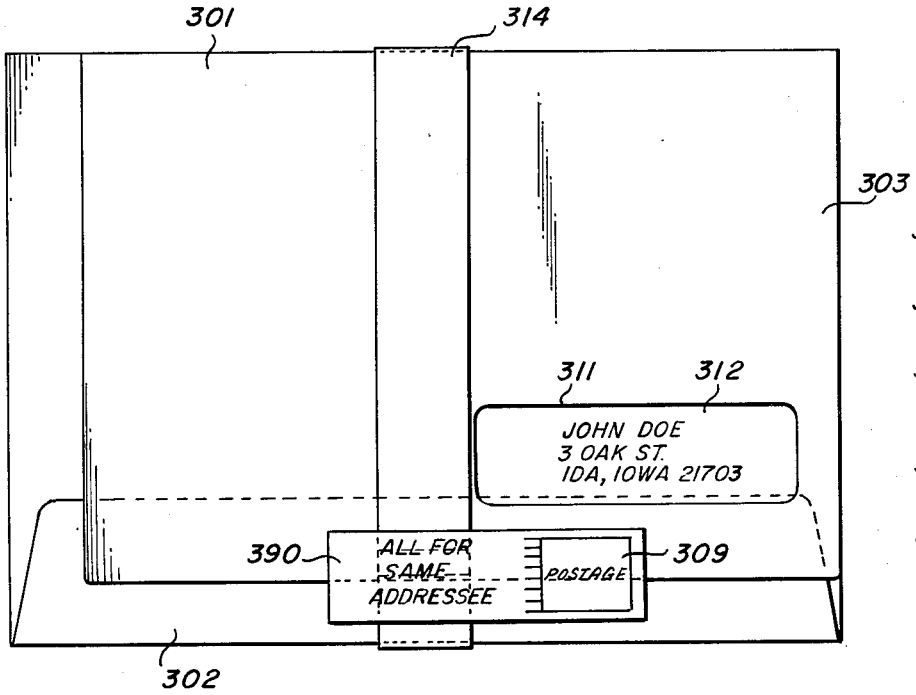
Fig. 15
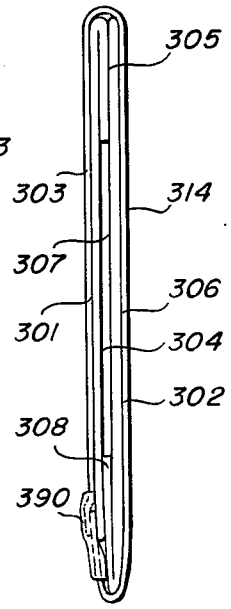
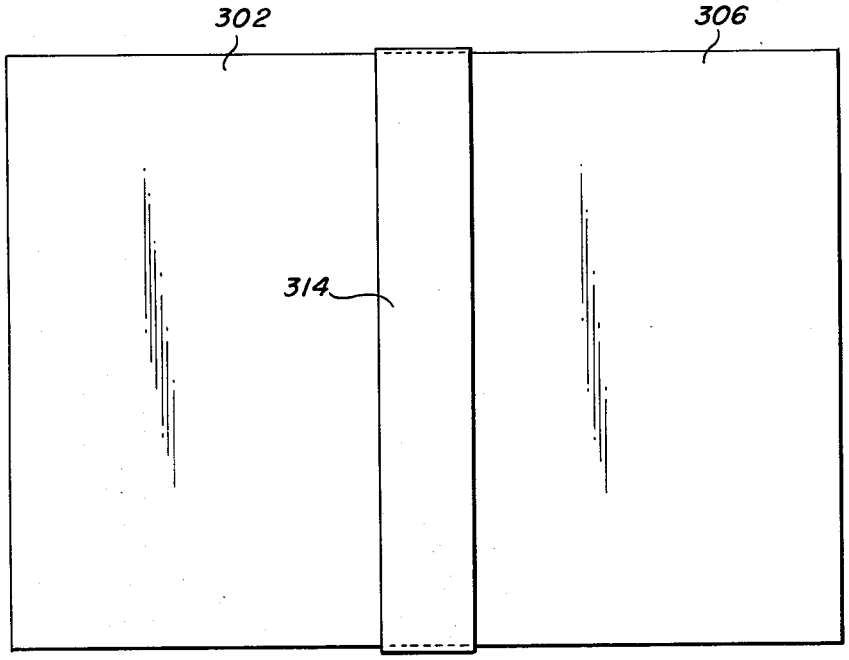
Fig. 16
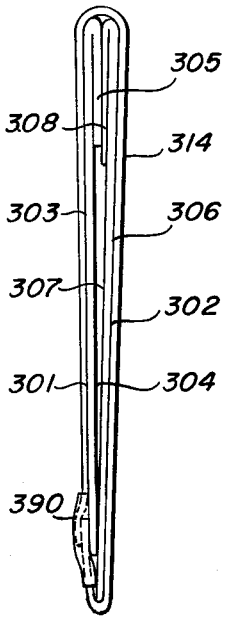
Fig. 17

MAILING ASSEMBLY

REFERENCE TO RELATED APPLICATION

This application is a continuation-in-part of my prior application Serial Number 659,034, filed Feb. 18, 1976, now abandoned, entitled "Mailing Assembly And Method Of Using Same".

This invention relates to a mailing assembly and, more particularly to an assembly of two or more initially independent, mailable items, such as letter sheets, postal cards, booklets or envelopes, banded, or otherwise held together for mailing as a single mailing piece. Each of the items usually contains or carries communication material which differs from the communication material contained or carried by the other item or items.

The purpose of my mailing assembly is to allow plural individual, and initially independent communications items, each usually, but not necessarily, containing or carrying different communications material, for example, advertising material, to be transported under existing United States government postal rate schedules through the United States mails and delivered to the same address for a lesser cost than if each of such material-containing or carrying items is mailed individually.

The mailing assembly described herein, while specifically designed for use in mailing third class mailing material through the United States mails, is not to be considered to be limited to third class mail since, as the description proceeds, it will be clear that my invention is also useful when mailing mail other than third class mail.

The following example will illustrate one use of my novel mailing assembly.

Under current United States postal rates the postage cost for mailing a first class letter weighing one ounce or fraction thereof is thirteen cents. Thus, whether a letter weighs one-half of an ounce or a full ounce it costs the same to mail it. With my invention two, or conceivably even more, letters are assembled together so as to use to a mailer's advantage, the weight/price structure of the postal rates. For example, two first class letters each weighing three-eights of an ounce can be mailed to the same address using the inventive concepts set forth herein for a postage cost of thirteen cents, whereas sending the same two letters separately would cost a mailer twenty six cents for postage.

One object of the invention is to provide means whereby plural, different advertising or other communications items may be mailed at a total cost which will be considerably less than if each of such items is mailed separately.

Another object of the invention is to allow plural individual advertising offerings to be mailed together at a postage cost which will be considerably less than the cost at which such offerings could previously be mailed separately.

Another object of the invention is to provide a mailing assembly including individual material-containing envelopes which is acceptable for mailing through the United States mails.

A further object of the invention is to provide a mailing assembly consisting of two or more individual, enveloped, advertising offerings which are banded, or otherwise attached together, for mailing as a single mailing piece at a total cost which is less than if each individual enveloped offering is mailed separately.

Another object of the invention is to provide a novel mailing assembly whereby plural, individual publications, or communications such as, but not limited to both enveloped or wrapped or non-enveloped and non-wrapped letters, letter sheets, booklets, brochures, newsletters, postal cards, pamphlets, magazines, newspapers, books, advertisements, and the like, can be sent through the mails at less total cost than if each individual publication or communication is mailed separately.

Other objects of the invention will become apparent from the remainder of the specification and from the drawings and claims which form a part of this application.

In the drawings which form a part of this application, and which show several illustrative embodiments thereof:

FIG. 1 is a view of the front, or address, side of a first illustrative embodiment of my novel mailing assembly;

FIG. 2 is an end view of FIG. 1;

FIG. 3 is a view of the rear face of the mailing assembly of FIG. 1;

FIG. 4 is a view of the front, or address side of a second embodiment of my novel mailing assembly;

FIG. 12 is an end view of a seventh illustrative embodiment of my invention wherein two postal cards are shown in the process of being banded together to form a novel unitary mailing assembly;

FIG. 13 is an end view of an eighth illustrative embodiment of my invention wherein a single fold-including mailable item representative of a folder, letter, letter sheet, brochure, newsletter, pamphlet, advertisement or small newspaper, or the like, and a plural page, bound or unbound booklet, or book are shown in the process of being banded together to form a novel unitary mailing assembly.

FIG. 14 is a view of the front or address side of a ninth illustrative embodiment of my novel mailing assembly;

FIG. 15 is an end view of FIG. 14;

FIG. 16 is a view of the rear face of the mailing assembly of FIG. 14; and FIG. 17 is an end view, similar to FIG. 15, but showing the larger envelope inverted with its flap-including edge up rather than down as in FIG. 15.

Figure 5:
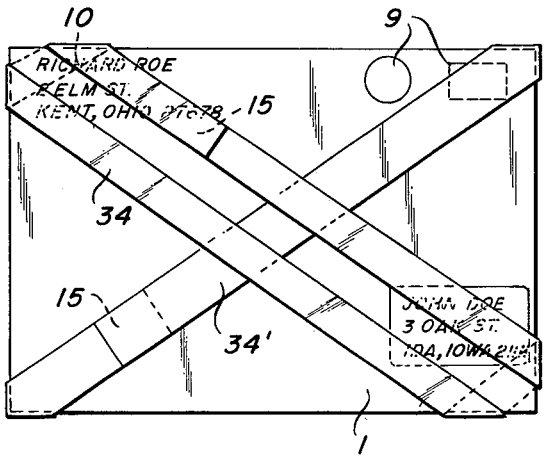
FIG. 5 is a view of the front, or address side of a third illustrative embodiment of my novel mailing assembly.

Referring now to the drawings, FIGS. 1, 2, and 3 show a first illustrative embodiment of my invention. More specifically, numeral 1 designates a first mailing envelope, and 2 designates a second mailing envelope. Envelopes 1 and 2 may be of identical construction, or may differ in type and size as discussed further hereinafter.

The envelopes utilized in practicing my invention may be conventional paper, windowed-type, flap-closing envelopes. However, other materials than paper, for example, plastic may be used as the stock material from which the envelopes are made, and non-windowed and even flapless envelope types can be utilized in practicing my invention.

The specific envelopes illustrated in FIGS. 1, 2 and 3 of the drawings are of the paper, windowed, flap-closing type.

Envelope 1 includes a front face 3, a rear face 4 and a flap 5. Similarly, envelope 2 includes a front face 6, a rear face 7 and a flap 8. The front face of envelope 1 carries on its upper right hand corner at 9 printed postage indicia, for example, to show that third class bulk rate postage has been prepaid, or appropriate postage stamps. A return address may or may not appear at location 10 on face 3 as desired.

Numeral 11 in FIG. 1 designates a transparent or cutout window through which an address 12 carried by the communications material, for example, advertising matter 13 within envelope 1 may be read. Envelope 2 also contains communications material, now shown, which normally is of a different character, for example, is advertising a different goods or service, than the communications material in envelope 1.

In the embodiment of FIGS. 1 to 3 the front 6 of envelope 2 and the backs 4 and 7 of both of envelopes 1 and 2 need carry no indicia whatsoever, although advertising or other indicia may be provided thereon if desired. Flaps 5 and 8 may or may not carry the usual gummed adhesive area (not shown) for use in sealing the envelopes depending on the class of mail in which my invention is to be used. For example, if my mailing assembly is to be used in third class mailing no adhesive area is necessary since envelopes 1 and 2 need only be closed, but not sealed. If my mailing assembly is to be used for first class mailing, than an adhesive area, as described, would be provided and envelopes 1 and 2 would normally be sealed when mailed.

In order to hold envelopes 1 and 2 together during their transportation through the mails, a strip or band 14 of paper or plastic material is placed tightly around envelopes 1 and 2 as best shown in FIG. 2. Such band 14 is conveniently formed of a strip of one of the materials just mentioned above which has its two free ends overlapped and adhesively secured together, as at 15, in the case either paper or plastic material is used, or alternately heat-sealed together in the case plastic material is used.

Band 14, alone, in many instances is sufficient to hold envelopes 1 and 2 and their contents securely in assembled relation during their transit from sender to addressee through the mails, particularly when envelopes 1 and 2 are identical duplicates. However, in those mailing situations where several handlings are anticipated, or when envelopes 1 and 2 are of different sizes or shapes, the integrity of my mailing assembly during its transit from sender to a designated address or addressee through the mails may be rendered more positive by the use of at least two of the three glue spots 16, 17, and 18. Glue spot 16 may be utilized to affix band 14 to the front 3 of envelope 1, while glue spot 18 may be utilized to affix band 14 to the flap 8, or alternatively to the back 7 of envelope 2. Glue spot 17 may be utilized to affix the back of envelope 1 to the front of envelope 2.

When the mailing assembly of FIGS. 1, 2, and 3 is to be assembled and used, envelopes 1 and 2 are first printed exteriorly as desired, and are then individually filled with whatever communications materials it is desired to mail. The material 13 in envelope 1 will carry delivery address indicia 12 visible through window 11. The flaps 5 and 8 are then closed and sealed, if desired, and envelope 1, after having had appropriate postage indicia or stamps placed or printed thereon, is positioned in engagement with envelope 2 as shown, either with or without glue spot 17 interposed between envelopes 1 and 2. Then band 14 is formed into a closed loop around envelopes 1 and 2 either with or without the utilization of glue spots 16 and 18 shown, and my mailing assembly is now ready for transport from the sender to the designated address or addressee.

Upon receipt by the addressee, it is only necessary, if glue spots 16, 17 and 18 are not used, to slide envelopes 1 and 2 out of band 14 in order to then open the envelopes to gain access to the material therein. If glue spots 16 and/or 17 and/or 18 are used, the envelopes can still be slid out of band 14 after enough shearing force is developed to rupture whatever glue spots are utilized. Since glue spots 16, 17 and 18 are quite small in extent, only a relatively small force is required to rupture them.

In place of, or in addition to glue spot 16, I may utilize an adhesive sticker 90 to secure band 14 to face 3 of envelope 1 as shown in FIG. 1, wherein part of the adhesive 91 which covers the entire back side of sticker 90 is shown in adhesive engagement with envelope face 3, while another part of the adhesive 91 on the back of sticker 90 is shown to be overlapping and adhesively secured to band 14.

It will be further noted, in reference to FIG. 1, that sticker 90 engages band 14 in such fashion as to secure the exposed end of band 14 to the unexposed end of band 14. Such securement of the ends of band 14 by sticker 90, as just described, can be used in addition to the securement obtained by the adhesive at 15, in order to reinforce the joinder obtained by 15, or, in some instances, if desired, adhesive 15 can be eliminated and sticker 90, alone, can be utilized to join the ends of band 14 together so as to form the endless loop shown.

The United States Postal Service is now using gummed indicia bearing stickers of the type shown at 90 to convey various information to its personnel while mail is being sorted, routed, and handled. For example, a blue sticker, of the type shown, which has the letter "F" printed thereon is used to indicate that all of the mail in a particular bundle, to which the sticker is applied, is to be delivered to the same addressee. Since in many instances in the utilization of my novel mailing assembly all of the individual mailing items contained within band 14 will be delivered to the same addressee, sticker 90 may not only serve as a primary or secondary securement means, but sticker 90 may also serve to advise mail handlers that all of the material within band 14 is to be delivered to the same addressee. Another benefit derived from the use of sticker 90 flows from the fact that a mail handler seeing such a sticker will be alerted so that band 14 will not be broken by postal service personnel. This alerting of mail-handling personnel will help to insure that each mailing assembly will be delivered to the intended addressee intact.

In FIG. 4, I show an alternate embodiment of my mailing assembly. This embodiment differs from the embodument of FIGS. 1, 2 and 3 in that strip or band 24 is located around the lengths of envelopes 1 and 2 instead of around the widths as is the case with band 14 in FIGS. 1, 2 and 3. In addition sticker 90 is used in this embodiment as the sole means to fasten the ends of band 24 together, thereby doing away with the necessity of providing an adhesive or heat-sealed area on band 24 such as at 15 in FIG. 1. Further, envelope 1 in FIG. 4 is non-windowed, and neither it, nor envelope 2 carry delivery address information or postage stamps or indicia. Rather, the address 92 to which the mailing assembly of FIG. 4 is to be delivered is printed directly on band 24, and the postage stamps or indicia 9 are also located on band 24, as shown.

The assembly and use of the mailing assembly depicted in FIG. 4 will be easily understood considering the description already set forth hereinabove relative to the embodiment of FIGS. 1, 2 and 3.

FIG. 5 shows a further embodiment of my envelope assembly which differs from the embodiment of FIGS. 1, 2 and 3, previously described, in that glue spots 16, 17 and 18 are not necessary, and because strips or bands 34 and 34', which tightly encircle envelopes 1 and 2 to hold them together, are transparent and are located diagonally around the envelopes rather than being oriented either vertically as in FIG. 1, or horizontally as in FIG. 4. Bands or strips 34 and 34' are transparent so that indicia, for example, address indicia, which underlies bands 34 and 34' can be read through band 34 and 34'. Both of bands 34 and 34' may be utilized, as shown, or alternatively, either band 34 or band 34' may be used alone if desired. No glue spots, such as spots 16, 17 or 18 normally need to be utilized in this embodiment, although such spots can be used if desired to more securely attach the assembly together.

Figure 6:
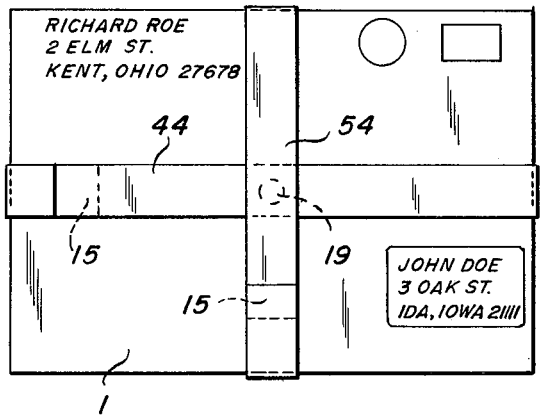
FIG. 6 is a view of the front, or address side of a fourth illustrative embodiment of my novel mailing assembly.

FIG. 6 shows yet another embodiment of my invention wherein two bands or strips are employed to secure envelopes 1 and 2 together. Band or strip 44 runs horizontally around envelopes 1 and 2 like band 24 in FIG. 4, and band or strip 54 runs vertically around envelopes 1 and 2 like band 14 in FIG. 1. No glue spots, such as spots 16, 17 and 18 normally need to be utilized in this embodiment, although, again such spots may be used if desired. For example, it may be desirable to utilize one glue spot 19 between bands 44 and 54 at one of their crossing points.

To extract envelopes 1 and 2 from the banding means shown in FIGS. 5 and 6 a person can either cut or tear the bands, or alternately, bands 44, 54 can be slipped off after any glue spots, e.g. 19, are sheared, and plastic band 34' can be stretched slightly so that it can then be slipped off. Band 34 can be made of stretchable or non-stretchable transparent material, as desired.

Figure 7:
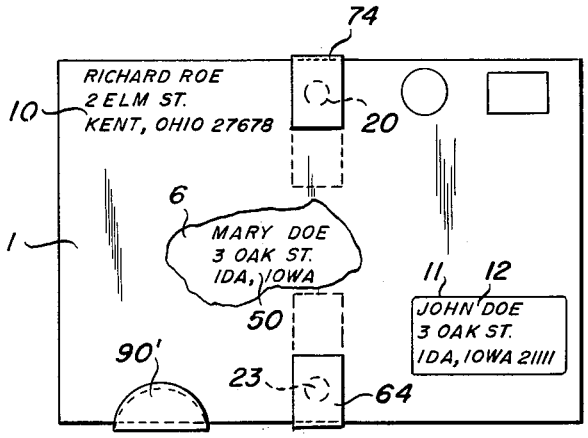
FIG. 7 is a view of the front, or address side of a fifth illustrative embodiment of my novel mailing assembly with the portions broken away for clarity.
Figure 8:
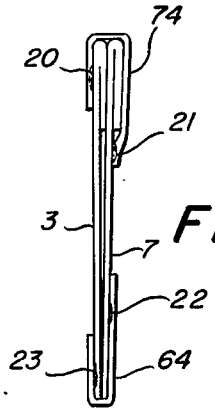
FIG. 8 is an end view of FIG. 7.

FIGS. 7 and 8 show another embodiment of my invention in which top and bottom holding strips 74 and 64, respectively, are utilized to hold envelopes 1 and 2 together for mailing. Strip 64 is attached to the bottom of the front face 3 of envelope 1 by means of a glue spot 23, and to the bottom of the rear face 7 of envelope 2 by means of a glue spot 22. Strip 74 is attached to the top of the front face 3 of envelope 1 by a glue spot 20 and to the rear face 7 of envelope 2 below the lower edge of flap 8 by a glue spot 21. If flap 8 has been previously adhesively sealed to rear face 7, then strip 74 can be made shorter and attached by a glue spot to flap 8. One or more folded, adhesive-backed stickers 90', similar to stickers 90, previously described, can also be used, as shown in FIG. 7, in addition to, or as substitutes for strips 64 and 74 in holding envelopes 1 and 2 together. Stickers 90' may or may not carry indicia on their exposed faces, as desired. Stickers 90' can also be similarly used on any of the other illustrated embodiments of the invention, if desired.

FIG. 7 is partly broken away to show an address 50 printed on the front 6 of envelope 2 to a different addressee than the addressee seen in the address 12 visible through window 11. Address 50, it will be noted, is hidden from view once envelopes 1 and 2 have been attached together into a mailing assembly, and remains hidden until such assembly is disassembled normally by the addressee of envelope 1.

Figure 9:
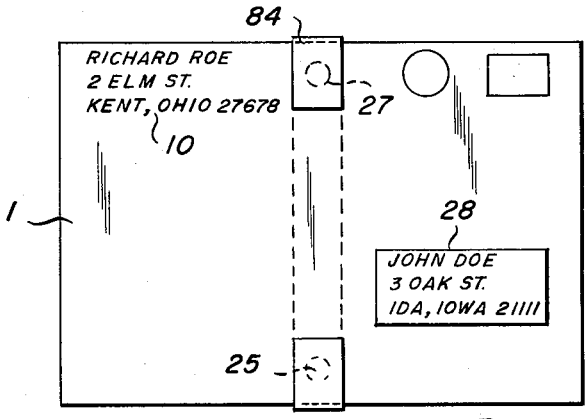
FIG. 9 is a view of the front, or address side of a sixth illustrative embodiment of my novel mailing assembly.
Figure 10:
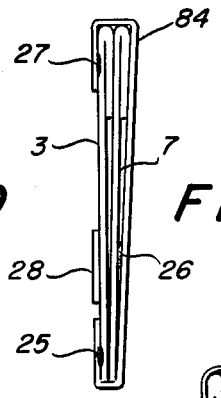
FIG. 10 is an end view of FIG. 9.

FIGS. 9 and 10 show another embodiment of my invention in which a single holding strip 84 is utilized which only partially encircles envelopes 1 and 2. One end of strip 84 is attached to the front face 3 of envelope 1 by a glue spot 27, and the other end of strip 84 is attached to the front face of envelope 1 by a glue spot 25. An additional glue spot 26 may be utilized to attach a central portion of strip 84 to the rear face of envelope 2 if desired.

The individual envelopes 1 and 2 of FIGS. 7 and 8 can be separated either by severing strip 74 between glue spots 20 and 21 and strip 64 between glue spots 22 and 23, or by manipulating envelopes 1 and 2 so as to shear off enough of the four glue spots 20, 21, 22 and 23 to allow envelopes 1 and 2 to be separated.

The individual envelopes 1 and 2 of the mailing assembly of FIGS. 9 and 10 can be separated, if glue spot 26 is not utilized, either by severing strip 84 between glue spots 27 and 25, or by shearing at least one of the two glue spots 27 and 25. If glue spot 26 is used, then envelopes 1 and 2 can be separated by severing band 84 between spots 26 and 27, and between 25 and 26, or by shearing off any two of the three glue spots 25, 26 and 27.

Although envelopes 1 and 2 have been shown in the drawings as being the same size and shape, it is not necessary that two identically sized and shaped envelopes be used. For example envelope 1 of FIG. 1 could conceivably be longer, but of the same width as envelope 2. Also envelopes 1 and 2 can be made of different materials. For example, envelope 1 may be made of paper, and envelope 2 may be made of a transparent plastic such as polyethylene, as in U.S. Pat. No. Re. 26,371 granted to me on Apr. 9, 1968.

Figure 11:
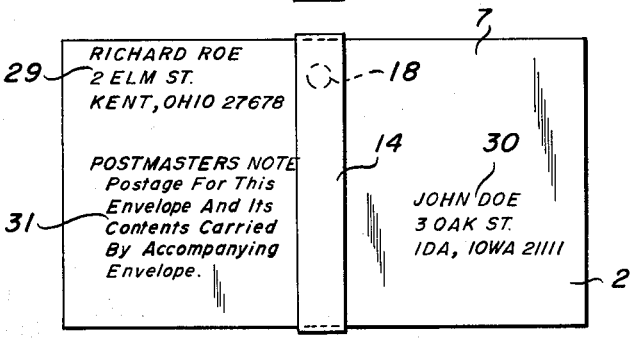
FIG. 11 illustrates supplemental address and informative indicia which can, if desired, be applied to the rearwardmost envelope face of any of the embodiments thus far illustrated.

FIG. 11 shows, utilizing the embodiment of FIGS. 1, 2 and 3 by way of example, how supplemental informative or advertising indicia can be applied to the rear face 7 of envelope 2. For example, 29 designates a return address which is a duplicate of return address 10 on face 3 of envelope 1. Numeral 30 designates a delivery address which is a duplicate of address 12 on advertising matter 13; and 31 is illustrative of various types of informative and/or advertising indicia that may be placed at various locations on rear face 7 of envelope 2.

In the event envelopes other than a window-including type are utilized for envelopes 1 and 2, then the delivery address can be printed directly on the face 3 of envelope 1, or can be printed on a conventional gummed label such as 28 in FIG. 9 which label is adhesively fixed to the front face 3 of envelope 1.

It is also within the purview of my invention to place the backs of envelopes 1 and 2 in engagement during the formation of the various mailing assemblies disclosed rather than having the front face of envelope 2 always contact the rear face of envelope 1 as shown. The illustrated embodiments and orientations of envelopes 1 and 2, however, are normally preferred.

It is also within the purview of my invention to utilize initially independent mailable items other than enveloped material in practicing my invention. FIG. 12 is similar to FIG. 1 to 3 except that a banded mailing assembly of two postal cards 101 and 102 are utilized in lieu of the two communications containing envelopes 1 and 2 of FIG. 1. Face 103 of card 101 may have printed, or otherwise attached thereon the requisite address and postage indicia or stamps necessary to properly direct the assembly of FIG. 12 to an addressee. Alternatively the requisite address and postal indicia just discussed can be placed on band 104 as in the embodiment of FIG. 4.

FIG. 12 is shown only partially assembled for clarity. However, it will be understood that the mailing assembly of FIG. 12 is readied for mailing merely by moving each end of band 104 in the direction of the arrows adjacent thereto until cards 101 and 102 are in firm engagement, after which the ends of band 104 are fastened together by one of the methods set forth hereinabove, so that band or strip 104 forms a closed loop, as previously described. Card 102, may, or may not, carry postal or address indicia, as desired.

FIG. 13 is quite similar to the embodiment of FIG. 12, except that instead of the postal cards of FIG. 12, a single fold-including communication item 201, for example a brochure, and a bound or unbound book or booklet formed of folded sheets 202 and 203 are shown in the process of being assembled into a unitary mailing assembly by means of strip or band 204. Either face 205 of sheet 203, or band 204 can carry the requisite address and postal indicia or stamps, as desired, and as previously described. If a binding such as adhesive or stitching is utilized to hold sheets 202 and 203 together, such binding will normally be located at the location represented by 206.

FIGS. 14, 15 and 16 show an embodiment of my invention wherein envelopes 301 and 302 are of different sizes with envelope 301 being both of lesser length and of lesser height than envelope 302. This contrasts, for example, with the embodiment of FIGS. 1, 2 and 3 wherein both of envelopes 1 and 2 are of the same size. In addition the embodiment of FIGS. 14, 15 and 16 also differs from the embodiment seen in FIGS. 1, 2 and 3 in other respects. In the embodiment of FIGS. 14, 15 and 16 envelope 301 is oriented with its flap-including edge upward while envelope 302 is oriented with its flap-including edge downward. In addition the flap-including side of envelope 301 engages the flap-including side of envelope 302. Finally, the gummed indicia-bearing sticker 390 shown in the embodiment of FIGS. 14, 15 and 16 not only is utilized to hold the overlapped ends of transparent or non-transparent band 314 together in a manner similar to the way in which sticker 90 does in the embodiment of FIGS. 1, 2 and 3, but, in addition, sticker 390 is related to envelopes 301 and 302 in such manner that the gummed side thereof also engages and holds both of envelopes 301 and 302 substantially immovable relative to each other and relative to band 314 during mailing.

Several other advantages flow from the embodiment set forth in FIGS. 14, 15 and 16. First, because the flap-including side of envelope 302 is turned inwardly so as to engage the flap-including side of envelope 301, the entirety of face 306 can be utilized for exhibiting exposed advertising or other indicia when band 314 is made of transparent material, or alternatively all of face 306, except for the portion covered by band 314 can be utilized for exhibiting exposed advertising or other indicia as desired, when band 314 is made of non-transparent material since all of the postage for this mailing assembly is either carried by sticker 390, as described hereinafter, or is carried by the front face 303 of envelope 1, as at 9 on envelope 1 of FIG. 1, or by band 314 as has been previously discussed relative to 9 on band 24, for example. Secondly, by inverting envelope 301 relative to envelope 302, flap 305 of envelope 301 is made to engage a non-flap-including area on the rear face 307 of envelope 302. Likewise flap 308 of envelope 302 is made to engage a non-flap-including area on the rear face 304 of envelope 301 with the result being a more uniform thickness mailing assembly than the somewhat tapering assemblies illustrated by FIGS. 2, 8, 10 and 17. The advantage flowing from the opposite positioning of the flap edges of envelopes 301 and 302 as best shown in FIG. 15 is that, more complete mailing assemblies of this type can be packed in a given space than if both flap edges of each of envelope 301 and 302 are positioned at the same side as in FIGS. 2, 8, 10 and 17. If desired, opposite positioning of envelope flap edges as described relative to FIG. 16 can be utilized in any of the previously described envelope-including embodiments.

FIG. 17 illustrates another way envelopes 301 and 302 can be positioned while still leaving all or substantially all of face 306 exposed for advertising or other indicia. In FIG. 17, it will be noted the flap-including sides of envelopes 301 and 302 are in engagement with each other so that face 306 is exposed as just described. If desired the envelopes in any of the previously described envelope-including embodiments can be positioned with their flaps in engagement as described relative to FIG. 17 if only two envelopes are utilized.

The envelopes of FIGS. 14, 15, 16 and 17, if desired, can also be oriented so that the flap of the front envelope engages the face of the back envelope which is the orientation broadly illustrated in the embodiments of FIGS. 2, 8 and 10.

Figure 18:
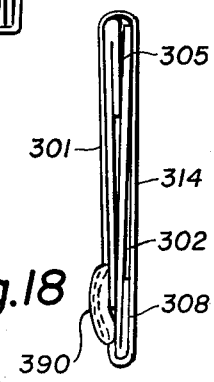
FIG. 18 is an end view of two banded envelopes presented for the purpose of illustrating another possible orientation of envelopes.

FIG. 18 shows an orientation of envelopes 301 and 302 wherein the front face of envelope 302 engages the rear or flap-including side of envelope 301. Four different orientations of two engaging flip-including envelopes are thus illustrated in end views FIGS. 2, 8, 10, 15, 17 and 18. The envelopes 301 and 302 as oriented in FIG. 18 may be held together as a single mailing piece in several of the different ways, previously described, and illustrated, for example, by utilization of the band 314 and sticker 390, in a manner similar to that illustrated in FIGS. 15 and 17.

Because sticker 390 adhesively engages both of envelopes 301 and 302 and band 314 in FIGS. 14, 15, 16 and 17, glue spots such as at 16, 17 and 18 in FIGS. 1, 2 and 3 are not usually required with the embodiments illustrated in FIGS. 14, 15, 16 and 17 although if unusually rough mail-handling is anticipated, one or more of such spots can be used, as deemed necessary The manner in which access is gained to the contents of the individual envelopes of FIGS. 14, 15, 16 and 17 by an addressee, or addressees in cases where a different addressee is designated on envelope 302 than that for envelope 301, will be apparent from the description given hereinabove relative to other embodiments of my invention.

Although each of the embodiments illustrated show only two separate or individual mailable items bound into each of my mailing assemblies, it should be understood that more than two such items can be utilized in the formation of any of my illustrated mailing assemblies. Also, as previously described relative to FIG. 7, it is not necessary that all of the separate items of each mailing assembly be destined for the same addressee. By way of example, three separate enveloped advertisements each weighing one-quarter of an ounce, can each have one of their exposed envelope faces provided with a different name and the common address of one of three different persons in a family all residing at a single address. These three enveloped advertisements, which advertisements may or may not be for the same goods, would then be banded, or otherwise attached together, as above described, after being oriented so that only one name and address face on one of the envelopes is visible. Assuming that this assembly is to be mailed as first class mail, and assuming that the band or other attaching means weighs less than one-quarter ounce, it will be understood that this assembly can be mailed for the current one ounce or fraction thereof postage rate of thirteen cents whereas if each of the three enveloped advertisements were to be mailed separately the postage charge would be three times as much or thirty nine cents. The potential reduction in postage expenditures, when utilizing my assembly is, therefore, quite great. Also the total cost of mailing my assemblies is still considerably less than mailing the individual items thereof separately, even though the cost of the banding or other fastening means and their emplacement must be included in the total cost of utilizing my novel assemblies, because the cost of the banding or other fastening means and their employment is considerably less than the postage savings realized when utilizing my invention.

It is to be understood that communications-containing envelopes of one type or another, postal and other cards, letters, letter sheets, news-letters, folders, books, booklets, newspapers, brochures, pamphlets, advertisements, and mailing sheets, and other printed or non-printed publications or communication items, as well as merchandise samples can be mixed as a user's whims or desires dictate within a given mailing assembly. It is also to be understood that any desired informative information can be placed on the various bands, stickers, and strips described. For example, a caution to postal personnel can be imprinted on band 14 whether sticker 90 is utilized or not, stating: "POSTAL PERSONNEL—DO NOT REMOVE BAND. ALL FOR SAME ADDRESS—".

In some instances where handling abuse in the transit of a mailing assembly from sender to receiver is expected to be minor, only a glue spot, such as glue spot 17 in FIG. 1, will be sufficient to retain envelopes 1 and 2 together for use as a mailable assembly.

It should be noted that tying or banding together of plural mailable items to aid in the sorting and/or other handling of such items for delivery from a sender to the postal service or during that transit through the mails is not in itself new since such tying or banding has been utilized for many years by senders and by the postal services both in the United States and abroad. However, as far as I can determine, I am the first to propose a mailing assembly and a method for using such assembly wherein plural, initially independent mailable items are banded or otherwise associated or fastened together into an assembly by a sender, and wherein such banded or otherwise fastened assembly remains intact until it reaches its ultimate destination and is disassociated again into independent items by the addressee or some other person at the ultimate destination. Further, I believe that I am the first to propose a mailing assembly of the type described herein which can be used in such manner that the total cost for mailing a plurality of initially independent mailable items will be considerably reduced from what the total cost of mailing each of the independent mailable items separately would be even though the cost of providing and emplacing the banding or other attaching means must be included when determining the total cost of mailing my novel assemblies.

An independent mailable item is defined herein as unattached enveloped or non-enveloped matter, usually, but not necessarily a printed or written communication, which may be provided with an address and which will be accepted by the United States Postal Service for transmission and delivery when properly addressed and when the requisite postage charges for such item have been paid.

It will be apparent from the preceeding description that the delivery address and postage need be viewable prior to delivery to the delivery address from only a single side of any of the various mailing assemblies now described. Thus, a user has the options of providing or not providing address or addressee information on the independently mailable items contained in any given assembly other than the item including such single viewable side. Further, as should now be clear from the preceeding description, addressee information if utilized on those independently mailable items other than the item including the above-noted single viewable side need not be the same as that which can be read from such single viewable side.

As previously mentioned the postage 309 for the mailing assembly shown in FIGS. 14, 15, 16 and 17 can, if desired, be carried solely by sticker 390. Such postage 309 can be either in stamp form, or can be in printed indicia form as is often used in pre-paid postage situations. Sticker 390 can, in fact, even be short strips of pre-paid postage bearing gummed tape of the type dispensed by metered mail machines.

Numeral 311 in FIG. 14 denotes a window in envelope 301, and 312 denoted address information carried by communications material within envelope 301 viewable through window 311.

Having now shown and described my invention, what I claim and desire to secure by Letters Patent is:

1. A mailing assembly for use in the postal system of the United States of America in a class of mail wherein postage costs increase in steps related to increasing predetermined weights of matter mailed, and wherein one of said predetermined weights is represented by X, comprising: a plurality of initially independent mailable items of said class whose combined weight is represented by A; means having a weight which when added to A equals X or less associating said items together so that each of said items is at least partially exposed to view and so that said items plus said means form a unitary mailing piece; said mailing assembly including visible delivery address information, whereby said mailing assembly may be provided with the required postage for weight X and then deposited in and transported through the mails and delivered to said delivery address as a single entity, said means comprising a strip having opposite ends, surrounding all of said items and a sticker having an adhesive side adhered to each of said opposite ends and forming said strip into an endless band, said sticker also being adhered to at least two of said items.

2. The combination of claim 1, said items each having a front face, and said sticker means also being adhered to at least two of said front faces.

3. The combination of claim 1, said plurality of items comprising at least two items of different sizes.

4. The combination of claim 1, each of said items including an envelope.

5. A mailing assembly for use in the postal system of the United States of America in a class of mail wherein postage costs increase in steps related to increasing predetermined weights of matter mailed, and wherein one of said predetermined weights is represented by X, comprising: a plurality of initially independent mailable items of said class whose combined weight is represented by A; means having a weight which when added to A equals X or less associating said items together so that each of said items is at least partially exposed to view and so that said items plus said means form a unitary mailing piece; said mailing assembly including visible delivery address information, whereby said mailing assembly may be provided with the required postage for weight X and then deposited in and transported through the mails and delivered to said delivery address as a single entity, said means comprising an endless strip surrounding all of said items and a sticker having an adhesive side secured to said strip and to at least two of said items.

6. The combination of claim 5, said plurality of items comprising at least two items of different sizes.

7. The combination of claim 5, each of said items including an envelope.

8. The combination of claim 7 wherein each envelope is of a flap-closing type and wherein the flap-including edge of at least one of the envelopes is located on the opposite side of the perimeter of said mailing assembly from the flap-including edge of another of said envelopes.

9. The combination of claim 7, each envelope including a front and a back and wherein the front of one envelope engages the back of another envelope.

10. The combination of claim 7, each envelope including a front and a back and wherein the back of one envelope engages the back of another envelope.

11. The combination of claim 7, wherein each envelope is of a flap-closing type and wherein all of the flap—including edges of all of said envelopes are located at the same side of the perimeter of said mailing assembly.

12. The combination of claim 11 wherein the flap of one envelope engages the flap of an adjacent envelope.

* * * * *